United States Patent [19]

Melissa et al.

[11] Patent Number: 4,513,661

[45] Date of Patent: Apr. 30, 1985

[54] DOT MATRIX LINE PRINTER

[75] Inventors: Raymond F. Melissa, Santa Ana; Lorne H. Grummett, Costa Mesa; John C. Chamberlain, Irvine, all of Calif.

[73] Assignee: Trilog, Inc., Irvine, Calif.

[21] Appl. No.: 482,133

[22] Filed: Apr. 4, 1983

Related U.S. Application Data

[63] Continuation of Ser. No. 259,697, May 1, 1981, abandoned.

[51] Int. Cl.[3] ..... B41J 3/12

[52] U.S. Cl. ..... 101/93.04; 101/93.08; 400/121

[58] Field of Search ..... 400/124, 121; 101/93.04, 93.05, 93.08

[56] References Cited

U.S. PATENT DOCUMENTS

| | | | |
|---|---|---|---|
| 3,874,492 | 4/1975 | Hurst | 101/93.05 X |
| 4,127,334 | 11/1978 | Watanabe et al. | 400/124 |
| 4,248,147 | 2/1981 | Zenner | 101/93.05 |
| 4,300,845 | 11/1981 | Martin et al. | 400/124 |
| 4,314,282 | 2/1982 | Fischbeck et al. | 356/286 |

FOREIGN PATENT DOCUMENTS

| | | | |
|---|---|---|---|
| 27358 | 3/1981 | Japan | 400/320 |

OTHER PUBLICATIONS

*IBM Tech. Disc. Bulletin,* by E. G. Wiese, vol. 17, No. 12, May 1975, p. 3550.

*IBM Tech. Disc. Bulletin,* by J. E. Lisinski et al., vol. 20, No. 11B, Apr. 1978, pp. 4683–4685.

*Primary Examiner*—Paul T. Sewell

*Attorney, Agent, or Firm*—Freilich, Hornbaker, Rosen & Fernandez

[57] ABSTRACT

A dot matrix line printer/plotter apparatus for producing hard copy printout of digitally represented data. The apparatus utilizes one or more hammer banks, each mounted so as to shuttle across a paper web fed therepast. Each hammer bank carries a plurality of hammer assemblies, each of which can be individually actuated to print a dot as it sweeps across the paper. Each hammer bank is mounted on a circuit board which carries electronic circuitry to actuate the hammer assemblies thereon. The circuit boards are supported by leaf springs and driven by a stepper motor which shuttles the boards along linear paths to sweep each hammer assembly across a certain portion of the paper width. Each hammer assembly includes a hammer supported in a guide tube for linear movement between a retracted position and an extended position engaging the paper. A permanent magnet is provided to normally latch the hammer in its retracted position. Each hammer assembly further includes a coil energizable to null the action of the permanent magnet as to that hammer assembly and to thus permit a spring to propel the hammer to said extended position.

22 Claims, 8 Drawing Figures

DOT MATRIX LINE PRINTER

This is a continuation of application Ser. No. 259,697, filed May 1, 1981, abandoned.

BACKGROUND OF THE INVENTION

This invention relates generally to dot matrix printer/plotters suitable for producing hard copy printout of digitally represented data.

Various devices are well known for producing hard copy printout of digitally represented data. One class of such devices prints fully formed characters, e.g. a daisy wheel printer, whereas a different class of devices forms characters by printing multiple closely spaced dots appropriately arranged within a matrix of dot positions. Although dot matrix impact printers utilizing hammers or wires to strike a paper or ribbon are most widely used, nonimpact dot matrix printers employing other dot print elements, e.g. ink jet, are also well known.

Within the broad class of dot matrix printers, two different categories are readily commercially available; i.e. (1) serial and (2) line. Both categories of dot matrix printers have been widely discussed in the literature; e.g. see Mini-Micro Systems, January 1981, pages 60 and 97.

The dot matrix serial printer is characterized by the use of a print head, typically having nine vertically spaced wires, mounted to move horizontally back and forth across a paper web mounted for vertical movement. As the head moves across the paper, head solenoids are selectively actuated to impact the wires against the paper to print successive dot columns and thus, serially form characters, each typically within a matrix of nine dot positions high and nine dot positions wide. The paper is stepped after each line of characters is printed.

The dot matrix line printer differs from the serial printer in that a row of dots, rather than a line of characters, is printed between successive paper steps. As is described on page 70 of the aforementioned Mini-Micro Systems publication, a typical commercially available dot matrix line printer utilizes a bank of 44 hammers mounted on a shuttle which sweeps each hammer across three character positions over a 0.3 inch movement. As the shuttle sweeps across, the hammers are actuated at each position in the dot row at which a dot is required and the paper is vertically fed one dot row after each full sweep. The process continues through a total of 7 sweeps (or 9 sweeps when descender characters are to be printed) and then the paper is moved by one character line space, and the process is then repeated for the next line of characters.

Several U.S. Patents are directed to various aspects of dot matrix line printers including: U.S. Pat. Nos. 3,941,051; 4,127,334; 4,236,835.

SUMMARY OF THE INVENTION

The present invention is directed to an improved dot matrix line printer/plotter including multiple print element banks, each extending across the paper path, and operable to concurrently print in different dot rows.

In accordance with the preferred embodiment, the multiple print element banks are mounted so that each can shuttle across the paper path so as to sweep each element across multiple dot columns.

In accordance with a significant feature of the preferred embodiment, the multiple print element banks are coupled to a common drive motor and arranged so as to move in opposite directions to present an essentially balanced load to said motor.

In accordance with a still further feature of the preferred embodiment, each print element bank is comprised of a plurality of hammer assemblies physically supported on a circuit board mounted for linear reciprocal movement. Each circuit board preferably carries all of the electronic circuitry associated uniquely with the hammer bank supported thereon so as to facilitate servicing and minimize the required interconnections.

In accordance with a still further feature of the preferred embodiment, switch means are provided for enabling a user to selectively disable one or more of said multiple hammer bank boards so as to permit the printer to continue to function even if only one of the multiple hammer bank boards is operable.

In accordance with a different aspect of the invention, an improved compact hammer assembly is provided including a hammer mounted for linear movement from a retracted position toward the paper to be printed upon. The hammer is normally retained in the retracted position under the influence of a permanent magnet field. A bucking coil is provided, which when energized, nulls the permanent magnet field and allows a spring to propel the hammer toward the paper.

In the preferred embodiment, each hammer bank includes an elongated pole plate to which a plurality of spaced hammer assemblies are mounted in alignment. Each hammer assembly includes a guide tube having a coaxial pole pin secured therein. A hammer plunger portion is supported in each tube for reciprocal linear motion toward and away from the pole pin. A permanent magnet is oriented so as to produce a short flux path through the pole pin and plunger portion to draw the plunger against the pole pin, opposing the force of a coil spring urging the plunger away from the pole pin toward the paper path.

In accordance with a significant aspect of the preferred embodiment, the energizable bucking coil is wound on the tube so as to completely encircle the gap between the pole pin and plunger portion to produce the magnetic flux to buck the permanent magnet field and permit the spring to propel the hammer toward the paper path.

BRIEF DESCRIPTION OF THE DRAWING

A better understanding of the invention may be had by reference to the following description, taken in conjunction with the accompanying drawing, in which:

FIG. 4 is a plan view partially broken away, particularly illustrating a hammer bank and hammer printed circuit board and their relationship to paper path;

DESCRIPTION OF THE PREFERRED EMBODIMENT

Figure 1:
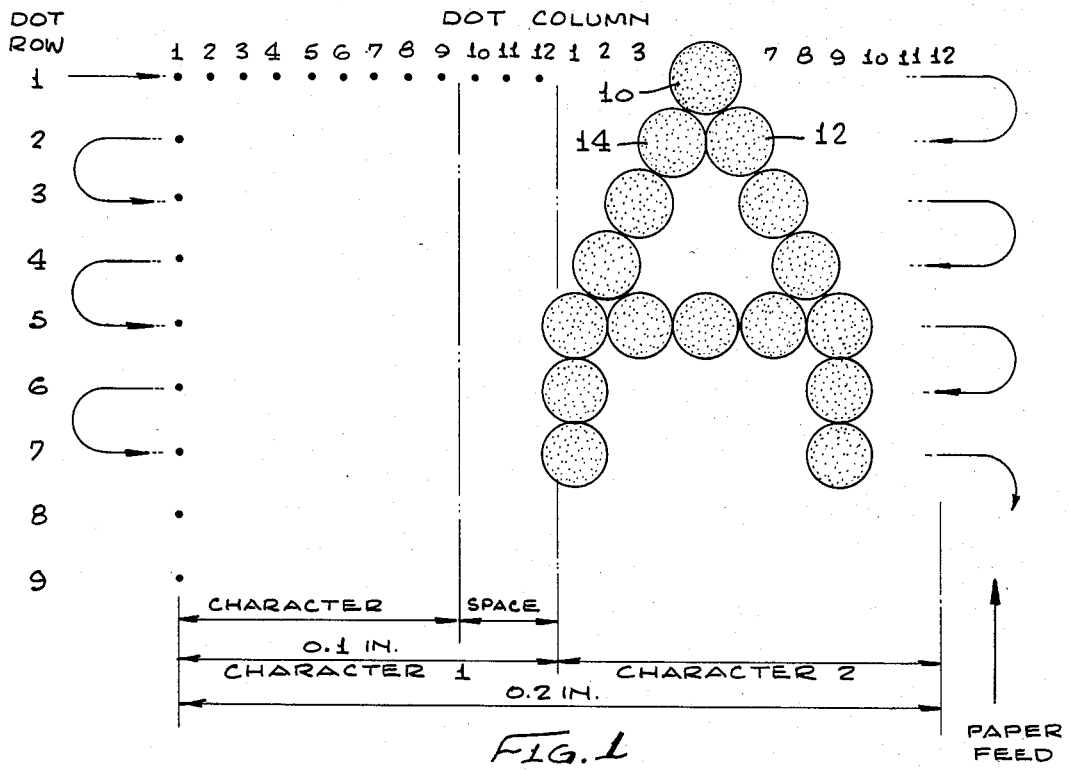
FIG. 1 is a schematic diagram generally depicting the manner in which a dot matrix line printer prints dots to form characters.

Attention is now directed to FIG. 1 which schematically depicts the manner in which a single print element of a typical dot matrix line printers operates to print or plot dot patterns which may, for example, comprise an alphanumeric character such as the letter "A" depicted in FIG. 1. Dot matrix line printers are well known and are discussed at length in the aforementioned patents and publication. They are characterized generally by the use of a bank of aligned print elements or hammers which shuttles across the width of a paper web which moves vertically past the bank. Typical commercially available dot matrix line printers are capable of printing 132 characters per line, each character typically formed by printing selected dots within a 9×9 matrix of dot positions. The term "dot row" is generally used to refer to the vertically spaced dot positions within the matrix and the term "dot column" is generally used to refer to the horizontally spaced dot positions within the matrix.

FIG. 1 depicts a character field comprised of twelve dot columns and nine dot rows. The character field is illustrated as having a width of 0.1 inches. Upper case characters are typically printed within a matrix which includes nine horizontal dot positions and seven vertical dot positions. Lower case characters with descenders are typically printed within a matrix of nine horizontal dot positions and nine vertical dot positions. As is depicted in FIG. 1, dot columns (10), (11), (12), within a character field are typically used for an intercharacter space.

In a typical dot matrix line printer, each print element or hammer sweeps horizontally along a dot row over multiple character fields. In the exemplary apparatus to be discussed hereinafter, each hammer bank will be assumed to include sixty six hammers with each hammer sweeping over two character fields; i.e. twenty four dot columns.

FIG. 1 schematically represents the manner in which a single hammer forms the letter "A". First, the hammer sweeps from left to right along dot row (1) and prints a dot 10 in column (5) of character field (2). After completion of the sweep for dot row (1), the paper is moved vertically by one dot row and the hammer then sweeps from right to left defining dot row (2). FIG. 1 depicts the printing of dots 12, 14 in dot columns (6) and (4) of character field two. Again, after the right to left sweep for dot row (2) is completed, the paper is moved vertically by one dot row to permit the hammer to sweep back from left to right to define dot row (3). Thus, by sweeping a single dot hammer back and forth over a portion of the width of the paper, alphanumeric characters such as depicted in FIG. 1 can be printed. It is pointed out that in addition to printing alphanumeric characters, dot matrix line printers can also be operated in a plot mode in which arbitrary dot patterns as defined by digital input data can be printed. Also it should be noted that although the dots depicted in FIG. 1 have been illustrated as merely touching one another, it is common practice to select the dot size so that adjacent dots partially overlap.

Whereas known dot matrix line printers utilize a single bank of aligned print elements extending across the width of the paper to be printed upon, embodiments of the present invention utilize two or more banks for concurrently printing along different dot rows. More particularly, attention is directed to FIG. 2 which depicts a paper web 20 to be printed upon which is fed vertically upward post multiple hammer banks 22,24,26. Each hammer bank carries a plurality of uniformly spaced dot print elements which may comprise impact hammers or wires or which alternatively can comprise nonimpact devices such as ink jet nozzles or thermal wires. Regardless of the particular structure of the print elements 28, the utilization of multiple banks 22,24,26, permits high speed printing while requiring only a relatively low duty cycle for the print elements 28.

In accordance with one embodiment of the invention, each bank carries sixty six uniformly spaced print elements and twenty four separate identical banks are provided. The twenty four banks are fixedly mounted but are successively horizontally displaced by one dot column. In such an embodiment, the hammers of hammer bank (1) would be dedicated to printing dot column (1) of all the character fields. Similarly, hammer bank (2) would print dot column (2), hammer bank (3), dot column (3), and finally hammer bank (24), dot column (24). It will be recognized that although in such an embodiment, each hammer bank would be dedicated to printing a different dot column, the banks would concurrently print in different dot rows. Thus, a dot row would not be entirely printed until it moved past all twenty four hammer banks. Although such an embodiment has the advantage that the hammer banks can be fixedly mounted, thus allowing for quiet operation, it requires a very large digital memory and is somewhat difficult to package and service.

Figure 2:
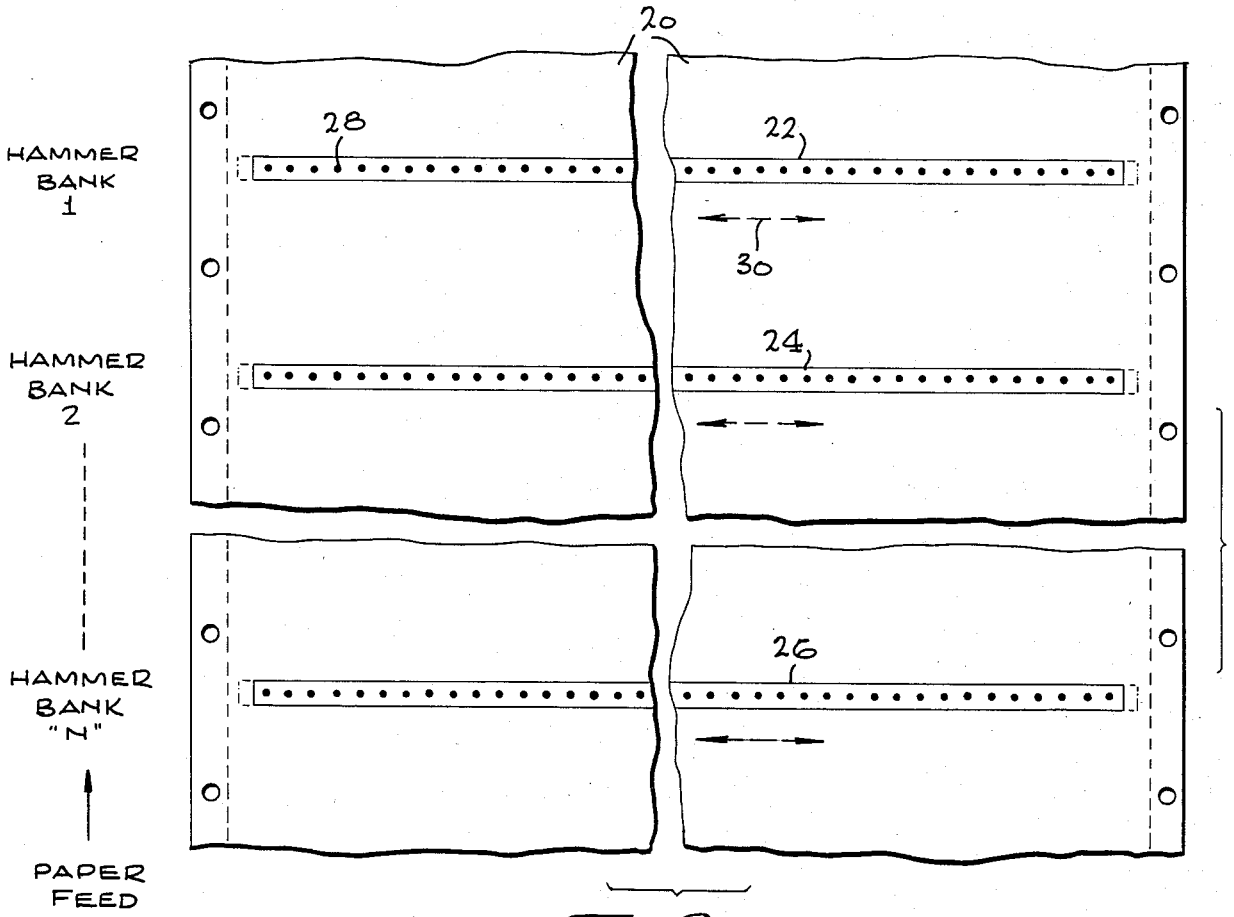
FIG. 2 is a schematic representation of a dot matrix line printer in accordance with the present invention in which a multiple number of hammer banks are provided to concurrently print in different dot rows.

In accordance with the preferred embodiment of the invention disclosed herein, in lieu of providing a sufficient number of banks to permit them to be fixedly mounted, a lesser number of multiple banks is provided with the banks being mounted for shuttling across the width of the paper web 20, as is represented by the dashed arrow lines 30 depicted in FIG. 2. More particularly, the preferred embodiment to be discussed in detail hereinafter utilizes two separate hammer banks, each including sixty six individually actuatable hammers, each of which is capable of printing a dot in twenty four different positions covering two character fields. Thus, in accordance with the embodiment to be discussed in detail hereinafter, depicted in FIGS. 3–8, each bank is capable of fully and independently printing a dot row.

Figure 3:
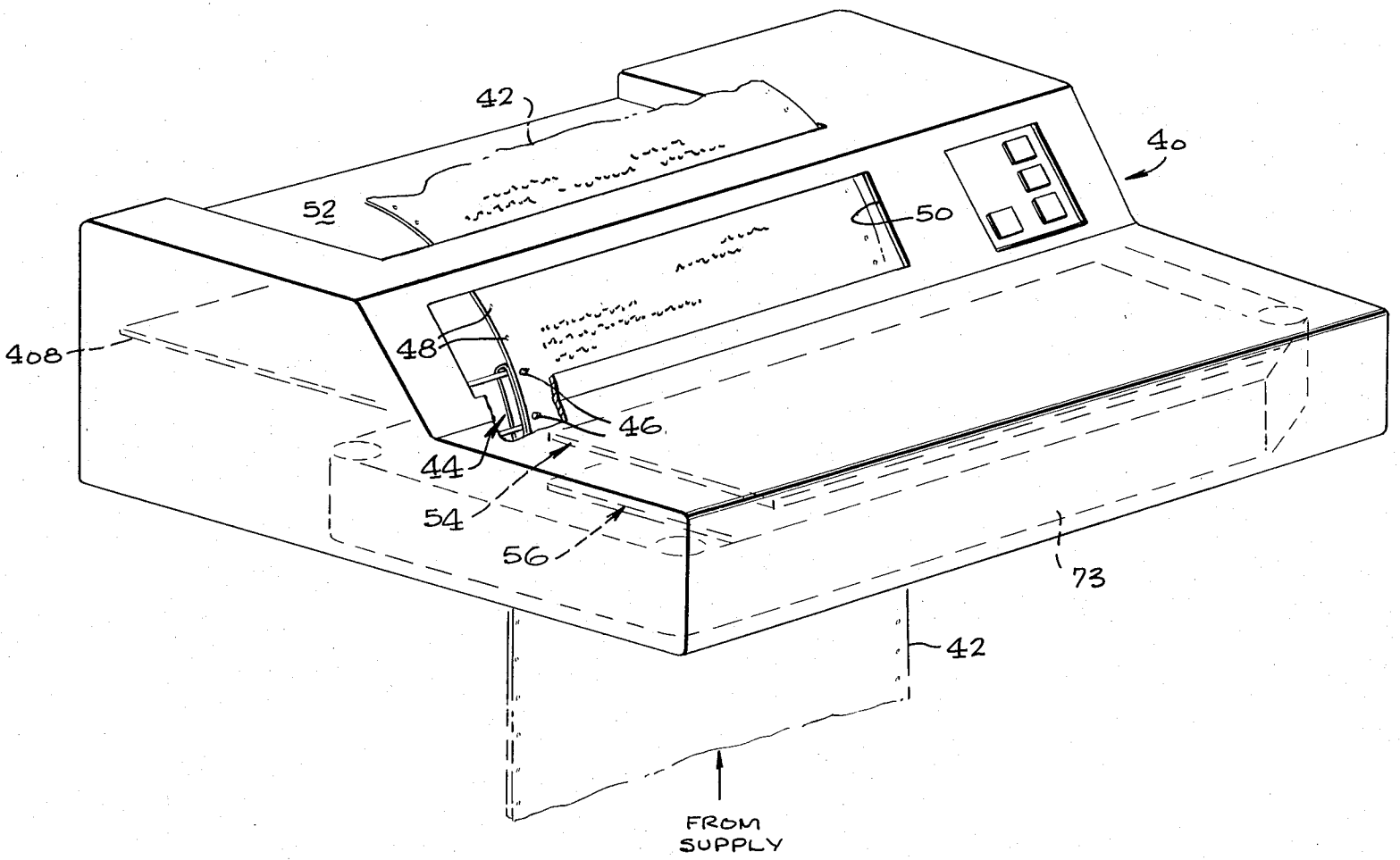
FIG. 3 is a perspective view generally depicting and embodiment of the present invention.
Figure 2:
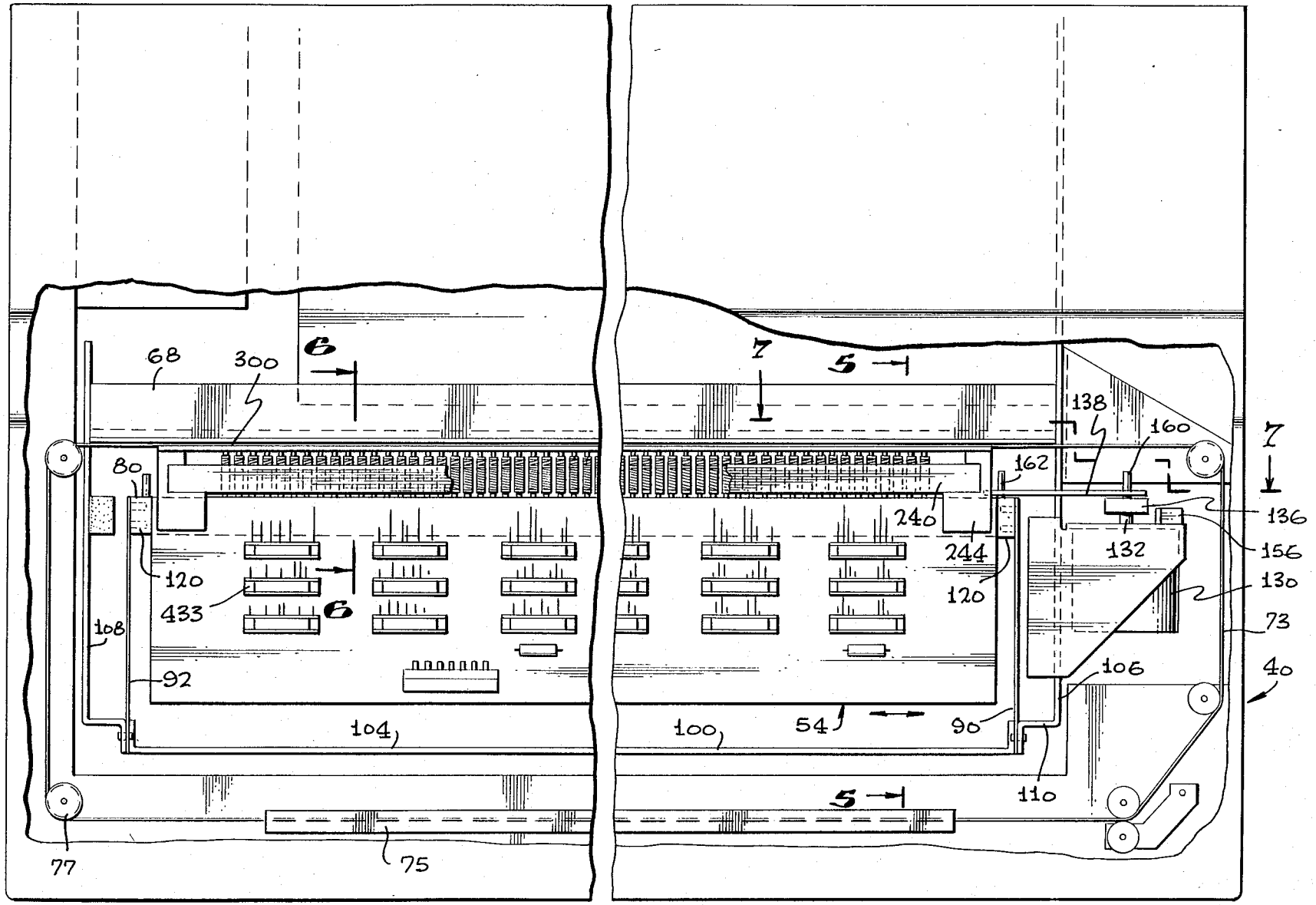

Attention is now directed to FIG. 3 which comprises a perspective view generally depicting the external appearance of an embodiment of the present invention. Briefly, the apparatus of FIG. 3 includes an exterior casing 40 which defines an opening 41 (FIG. 5) in the bottom plate thereof for receiving the paper web 42 from a supply (not shown). The paper feed system utilized in the apparatus of FIG. 3 is conventional and corresponds to other paper drive systems widely employed in existing commercially available printers. Briefly, the paper drive system includes a tractor 44 carrying pins 46 which engage sprocket holes 48 formed along the edge of the paper 42. The tractor 44 is driven by a motor (not shown) controlled by the processor unit of FIG. 8. The tractor 44 pulls the paper 42 upwardly from the supply along a defined paper path to be discussed hereinafter, past window 50 allowing it to exit to the rear of the unit over shelf 52. In pulling the paper 42 along the defined paper path, the paper is pulled past first and second hammer printed circuit boards 54 and 56 which respectively carry first and second hammer banks to be discussed in greater detail hereinafter.

Figure 5:
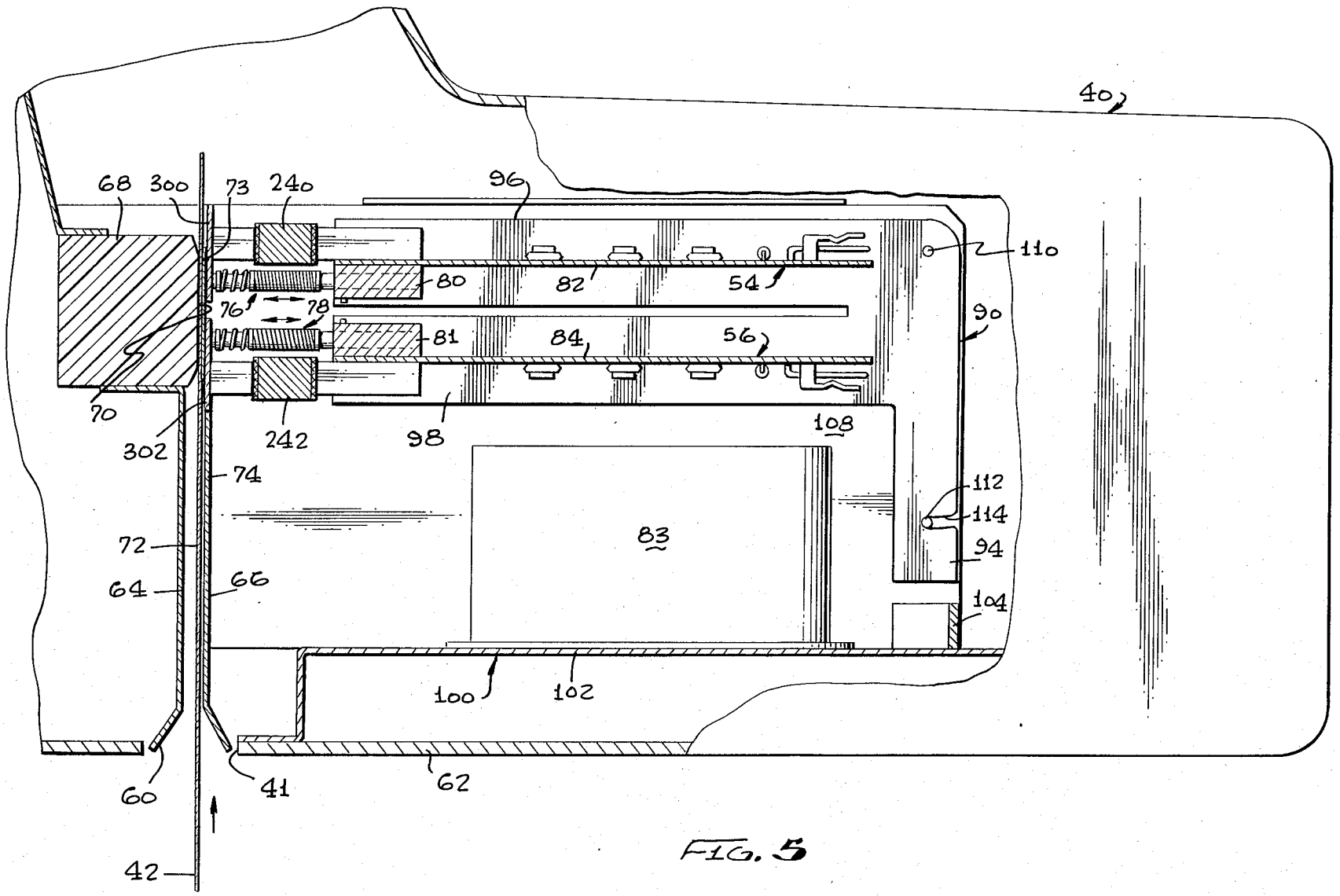
FIG. 5 is a sectional view taken substantially along the plane 5—5 of FIG. 4.

Attention is now directed to FIGS. 4–7 which illustrate the structural details of the functional units housed within the casing 40. More particularly, FIG. 4 or 5 illustrate opening 41 in the bottom plate 62 of the casing 40 for passing the paper 42 into a paper chute defined by paper guides 64 and 66. The paper 42 is pulled along the path defined by guides 64 and 66 by the aforementioned tractor 44 past platen 68. The platen 68 defines a flat front surface 70 engageable by the rear surface 74 of the paper web 42. A ribbon 73 is mounted so as to move horizontally across the platen surface 70 adjacent to the front surface 74 of the paper web 42. The ribbon 73 comprises an endless loop which is pulled from and returned to a conventional ribbon stuff box 75 under the control of a ribbon motor, not shown, along a ribbon path defined by guides 77.

Figure 6:
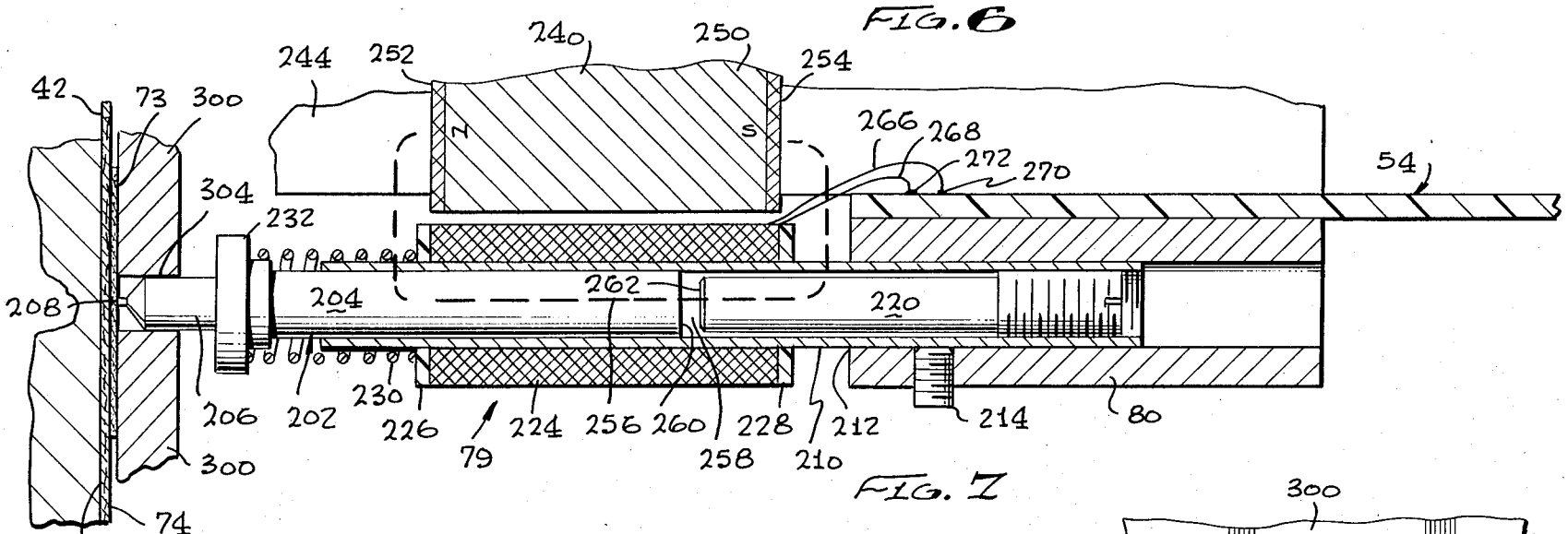
FIG. 6 is a sectional view taken substantially along the plane 6—6 of FIG. 4.

First and second hammer banks 76 and 78, mounted in opposition to platen surface 70 are each comprised of an elongated pole plate 80, 81 and a plurality of identical hammer assemblies 79, one of which is illustrated in detail in FIG. 6. In accordance with the preferred embodiment of the invention, the pole plate 80 of hammer bank 76 is secured to a first surface 82 of aforementioned printed circuit board 54. Similarly, pole plate 81 of hammer bank 78 is secured to surface 84 of printed circuit board 56.

The printed circuit boards 54 and 56 are mounted so as to be able to move laterally across the width of the paper web 42 which is vertically fed through the paper path defined by guides 64, 66 best depicted in FIG. 5. A cooling fan 83 is mounted on floor 100 beneath boards 54,56. In order to mount the circuit boards 54 and 56 for lateral movement, first and second identical F shaped leaf springs 90 and 92 are provided as depicted in FIGS. 4 and 5. FIG. 5 best illustrates F shaped leaf spring 90 as including a vertical leg 94 and first and second projecting fingers 96 and 98. The leaf spring 90 is mounted to a chassis 100 within the casing 40. The chassis 100 includes a floor 102, a rear wall 104 and first and second side walls 106 and 108. The leaf spring 90 is secured to side wall 106 by a single screw or similar fastener 110 which permits the leaf spring 90 to pivot upwardly (counter clockwise as viewed in FIG. 5) to provide easy servicing access to the boards 54 and 56. A positioning pin 112 is secured to the side wall 106 and is intended to bottom in slot 114 formed in the leaf spring leg 94 to vertically orient the leg 94 relative to the chassis floor. Note that the chassis side walls 106 and 108 are offset to provide clearance to permit the leaf springs 90 and 92 to flex about the fastener 110. That is, with reference to the leaf springs 90 and 92 as they appear in FIG. 4, they can flex both to the left and right of the solid line position indicated.

It has previously been mentioned that each hammer bank 76 and 78 includes an elongated pole plate 80,81 respectively secured to the circuit boards 54 and 56. As is depicted in FIG. 4, the plate 80 has a length greater than that of the board 54, thus extending beyond the ends thereof. The ends of the plate 80 are respectively secured to the upper fingers 96 of the leaf springs 90 and 92 as by screws threaded into holes 120. The circuit board 56 is similarly supported between the lower fingers 98 of the leaf springs enabling the boards 54,56 to independently move laterally, as viewed in FIG. 4, relative to the platen 68. In accordance with the preferred embodiment, the circuit boards 54 and 56 are reciprocally driven laterally by a common hammer bank stepper motor 130 as shown in FIG. 7.

Figure 7:
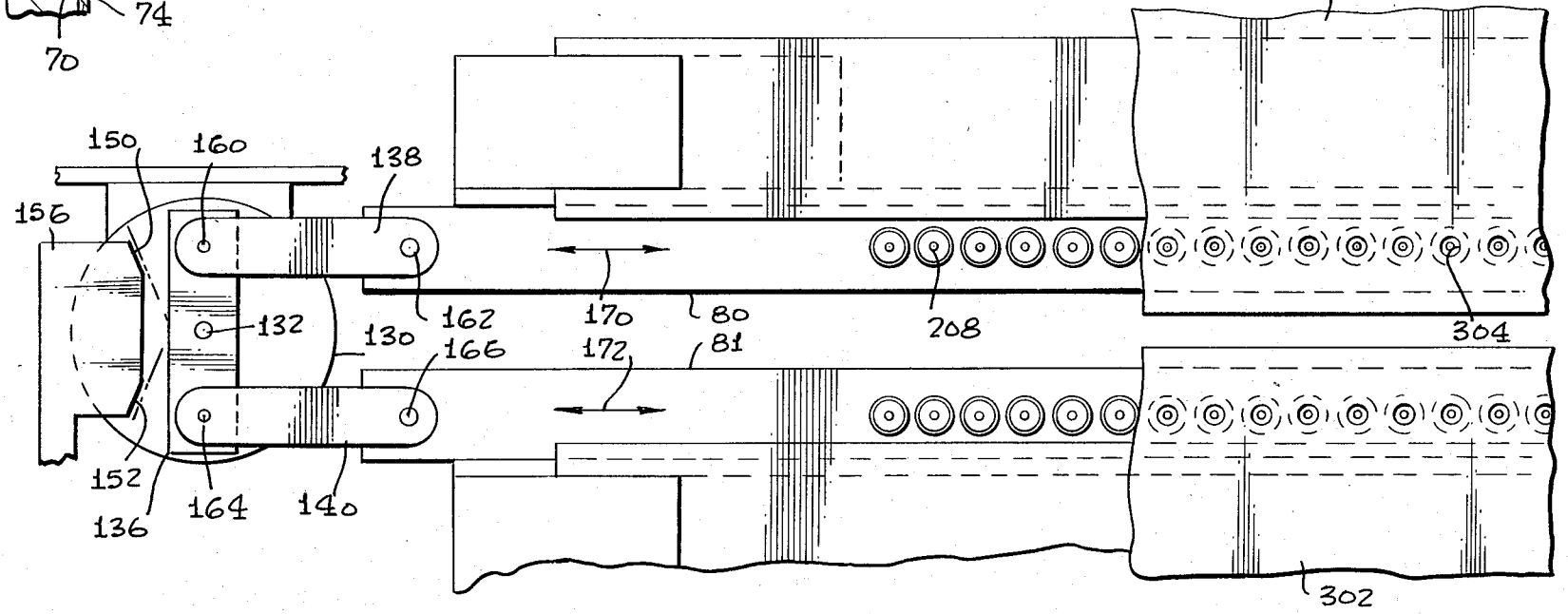
FIG. 7 is a sectional view taken substantially along the plane 7—7 of FIG. 4.

With reference to FIGS. 4 and 7, it is pointed out that motor 130 has an output shaft 132 which is coupled to pole plates 80 and 81 by member 136 and links 138 and 140. More particularly, elongated member 136 is secured to the motor shaft 132 and rotates therewith. The motor 130 is controlled by the processor unit of FIG. 8, so that it rotates alternately twenty four steps in one direction and then twenty four steps in the opposite direction. Thus, viewing the motor 130 in FIG. 7, the shaft 132 can rotate counter clockwise to move the member 136 to the phantom line position 150 and then rotate through twenty four clockwise steps to reach the phantom line position 152. Although the motor is controlled to assure that the member 136 is only rotated through twenty four steps from position 150 to 152 and vice versa, a mechanical stop in the form of block 156 is provided to assure that the member 136 does not rotate beyond its intended limits.

The first end of link 138 is mounted for rotation on pin 160 affixed eccentrically to the member 136. The second end of link 138 is mounted for rotation on pin 162 extending from pole plate 80. Similarly, link 140 is mounted for rotation on pins 164 and 166 respectively secured to member 136 and pole plate 81. Thus, as the motor shaft 132 rotates the member 136 through twenty four incremental steps from the phantom line position 150 to the phantom line position 152, the pole plates 80 and 81 will move along substantially linear paths represented by arrows 170 and 172 and the hammer assemblies carried by the pole plates will each sweep across twenty four dot positions. Note that the pole plates move in opposite directions during each sweep and that the motor 130 thus sees equal loads for both directions of rotation.

It has previously been mentioned that the hammer banks 76 and 78, carried by circuit boards 54 and 56, each include a pole plate 80, 81 and a plurality of identical hammer assemblies. Attention is now particularly directed to FIG. 6 which illustrates the details of one such hammer assembly 79. The hammer assembly 79 is comprised of a hammer 202 which includes a rear plunger portion 204 and a forward hammer portion 206 terminating in a print tip 208. As will be seen hereinafter, the hammer 202 is mounted so that it can be propelled forwardly toward the paper path to impact the tip 208 against the ribbon 73, paper 42, and platen surface 70. Impacting of the tip 208 against the ribbon 73, will print a dot defined by the cross sectional shape of tip 208 on the front surface 74 of paper 42.

The plunger portion 204 of hammer 202 is mounted within a tubular guide 210. The tube 210 is received within a hole 212 formed in pole plate 80. A set screw 214 secures the tube 210 within the hole 212. An elongated pole pin 220 is mounted within the tube 210 in alignment with the hammer plunger portion 204. A multiple turn bucking coil 224 is wound around the tube 210 between a pair of insulated flange members 226 and 228 fixed to the tube 210. A coil spring 230 is mounted on the tube 210 extending between the flange member 226 and a flange 232 formed on the hammer 202 between the plunger portion 204 and the hammer portion 206. The ends of the spring 230 are preferably secured, as by a suitable adhesive, both to flange member 226 and flange 232.

Each hammer bank 76 and 78 includes a plurality (assumed to be sixty six) of identical hammer assemblies, each mounted in a different hole 212 within a pole plate. An elongated permanent magnet 240, 242 is provided which extends over all of the hammer assemblies within the bank. Thus, as can be seen in FIG. 4, bar magnet 240 extends over all the hammer assemblies 79 within hammer bank 76 being retained at its ends by brackets 244 and 246 (FIG. 4).

FIG. 6 illustrates the permanent magnet 240 in greater detail as comprising a central elongated bar magnet 250 sandwiched between magnetic return plates 252 and 254. The bar magnet 250 is oriented so that its opposite elongated faces adjacent return plates 252 and 254 define the north and south poles. As a consequence, the magnet produces a flux path, represented by dashed line 256 extending from return plate 252 through hammer plunger portion 204, across gap 258, through pole pin 220, and thence to return plate 254. Note that return plates 252 and 254, hammer plunger portion 204 and pole pin 220 are all formed of magnetic material. On the other hand, tube 210 is preferably formed of a non magnetic material, such as brass.

The magnet 250 and spring 230 are selected so as to have characteristics enabling the magnet to oppose the force of spring 230 and draw the hammer plunger portion 204 into contact with the pole pin 220. That is, the hammer 202 is supported for linear movement within tube 210 between the extended position depicted in FIG. 6 and a retracted position in which the rear face 260 of the plunger portion 204 is drawn into contact with and latches against the front face 262 of pole pin 220 thus holding spring 230 in a compressed stored energy condition.

The aforementioned bucking coil 224 is wound around tube 210 and fully surrounds the gap 258 between the plunger portion 204 and pole pin 220. The leads 226 and 268 of coil 224 are respectively connected to solder pads 270 and 272 formed on the upper surface of circuit board 54. Energization of the bucking coil 224 produces a magnetic flux through pole pin 220 and plunger portion 204 to effectively null the flux produced therein by permanent magnet 250. As a consequence of nulling the permanent magnet field, the coil spring 230 is then able to expand to propel the hammer forwardly and impact the tip 208 against the ribbon 73, paper 42 and platen surface 70. By energizing the coil 224 with a very short pulse, the hammer 202 is propelled forward very rapidly and, after impact, rebounds rearwardly to enable the permanent magnet 250 to again latch the plunger portion 204 against the pole pin 220.

In order to prevent the ribbon 73 from snagging on the hammer tips 208, each hammer bank 76, 78 is provided with a hammer cover plate 300, 302, having holes 304 formed therein to permit the hammer tip to move therethrough to impact against the ribbon and paper. The ends of the hammer coverplate 300 are secured to the magnet brackets 244 and 246 (FIG. 4) and the coverplate thus shuttles with the circuit board 54.

From the foregoing it should now be understood that a dot matrix line printer/plotter construction has been disclosed which, in the preferred embodiment, employs first and second circuit boards, each carrying a hammer bank, and each mounted so as to shuttle back and forth across the width of the paper to be printed upon. The two circuit boards are driven by a common stepper motor which moves the boards in opposite directions along separate linear paths. As aforementioned, it has been assumed that each hammer bank includes sixty six hammers and that each hammer is stepped through twenty four dot positions alternately from left to right and then from right to left. One dot row is printed during each sweep from left to right, then the paper is moved by one dot row space and a second dot row is then printed from right to left. The two hammer banks operate concurrently and print different dot rows while moving in opposite directions. It is pointed out that as a consequence of the compact configuration of the hammer assemblies, they can be closely mounted, e.g. 0.2 inches, thus allowing sixty six hammer assemblies to be mounted within a 13.2 inch width. By utilizing a greater number of hammer assemblies, the duty cycle at which each is operated is reduced, as is the speed at which a bank must be shuttled to achieve a certain print speed, e.g. 150 lines per minute.

The apparatus thus far described can be operated in different manners. For example only, the two hammer banks can be utilized to print in alternate dot positions such that the printing of a full dot row requires the contribution of dots printed by both hammer banks. In the preferred manner of operation, however, the two hammer banks operate concurrently but each hammer bank is responsible for printing an entire dot row. Moreover, in the preferred manner of operating the aforementioned apparatus, each hammer bank is responsible for printing a multiple number of character lines equal to the physical spacing between the print rows defined by the aligned hammer tips in each bank. Thus, in accordance with one operating mode of the preferred embodiment, the hammer tips 208 of banks 76, 78 are vertically spaced by a distance equal to the spacing between three character lines to be printed. Accordingly, the apparatus of FIGS. 4–7 is controlled by the electronic circuitry of FIG. 8 such that hammer bank 76 prints three successive character lines and hammer bank 78 concurrently prints the next three successive character lines. Stated otherwise, hammer banks 76 and 78 concurrently respectively print character lines 1 and 4, then character lines 2 and 5, then character lines 3 and 6, then character lines 7 and 10, then character lines 8 and 11, etc. In the printing of each character line, it is assumed that the two hammer banks operate on corresponding dot rows. Thus, when hammer bank 76 is printing dot row 2 of character line 2, hammer bank 78 is printing dot row 2 of character line 5.

Figure 8:
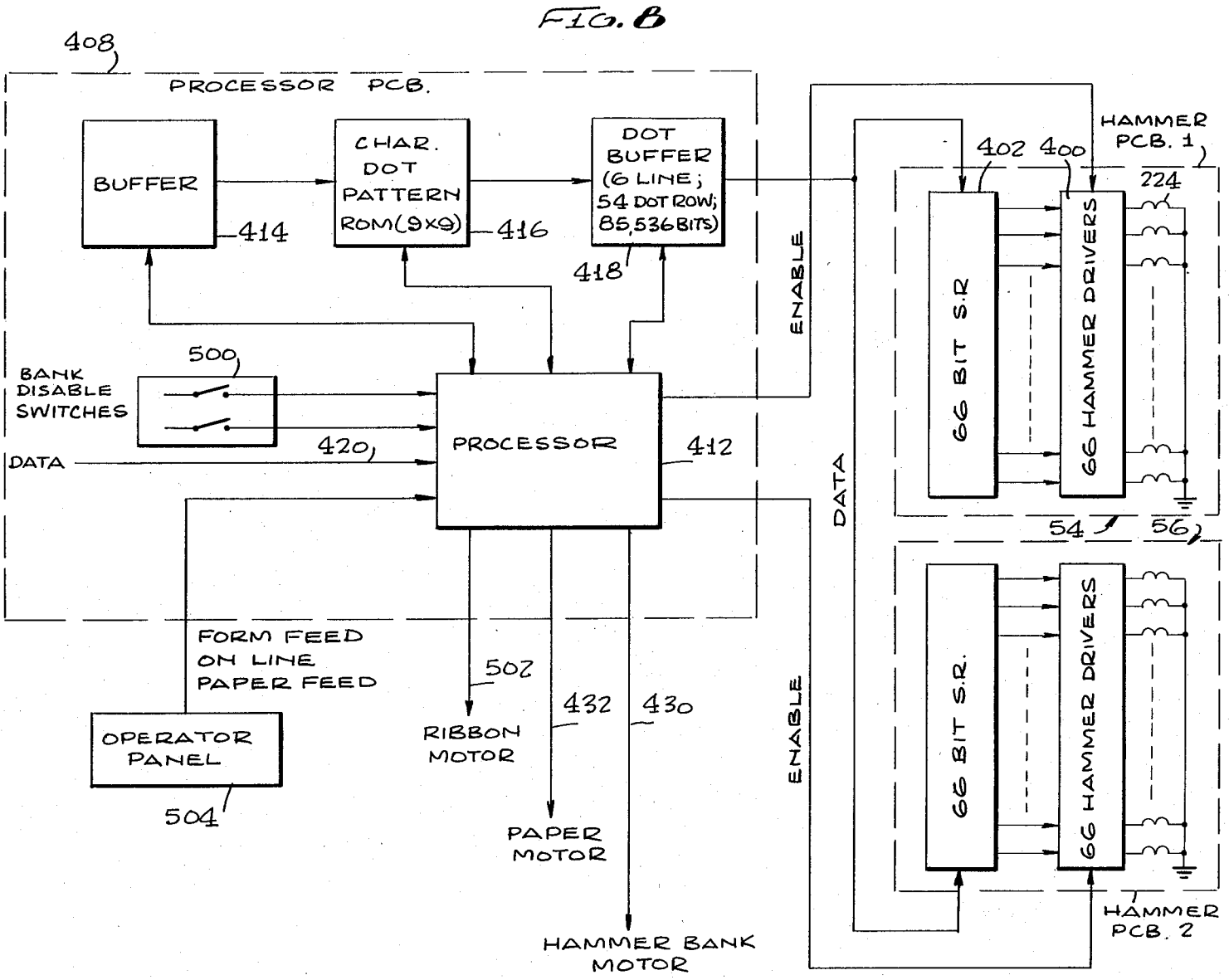
FIG. 8 is a schematic block diagram of electronic processing and control circuitry utilized in conjunction with the apparatus depicted in the FIGS. 3–7.

The aforedescribed operating mode will be clarified by reference to FIG. 8 which illustrates, by dashed line, circuit boards 54 and 56. Each circuit board carries sixty six bucking coils 224, which have previously been described in conjunction with FIG. 6. On each of the boards 54 and 56, each of the coils 224 is connected to one of sixty six hammer drivers 400. Each of the hammer drivers is controlled by a different stage of a sixty six bit shift register 402 also carried by the circuit board. Data supplied to the shift register 402 and timing pulses to enable the hammer drivers 400 are supplied from a processor printed circuit board 408 which is fixedly mounted within the casing 440 (FIG. 3).

The generalized block diagram of the processor board illustrated in FIG. 8 includes a processor unit 412, preferably microprocessor based, a buffer unit 414 for storing character codes, a character dot pattern read only memory 416, and a dot buffer 418. A data input line 420 is coupled to the processor and supplies character codes (e.g. ASCII). The processor 412 stores the received codes in the character code buffer 414 and character codes are then sequentially supplied to the character dot pattern read only memory 416 to convert each character code into the 9×9 dot pattern required to control the hammer drivers. For simplicity in explanation, the dot buffer 418 has been assumed to be sufficiently large so as to be able to store the entire dot pattern for six character lines; i.e. equal to fifty four dot rows. Since each dot row contains 1,584 dot positions, the dot buffer 418 will be assumed to contain 85,536 (1,584×54) bit storage devices. In normal operation, the processor unit 412 will cause the dot buffer to load the shift registers on boards 54 and 56 for each dot position of the board as it sweeps across the width of the paper. Thus, since it has been assumed herein that each hammer bank sweeps over twenty four dot columns, then it is necessary for the dot buffer to load the shift register twenty four times for each complete sweep. It has been assumed in FIG. 8 that each shift register is serially loaded with sixty six bits and then after loading that the sixty six hammer drivers connected thereto are fired in parallel based upon the bit content of the shift register.

In order to better understand the operation of the system as depicted in FIG. 8, attention is directed to the following table which depicts the information read from the dot buffer 418 during successive reads for each of the hammer circuit boards:

| | HAMMER BOARD 54 | | | HAMMER BOARD 56 | | | |
|---|---|---|---|---|---|---|---|
| READS | CHAR LINE | DOT ROW | DOT COL. | CHAR LINE | DOT ROW | DOT COL. | |
| (1) | 1 | 1 | 1 | 4 | 1 | 24 | |
| (2) | 1 | 1 | 2 | 4 | 1 | 23 | |
| (3) | 1 | 1 | 3 | 4 | 1 | 22 | |
| . | | : | | | : | | DOT ROW SPACE |
| (24) | 1 | 1 | 24 | 4 | 1 | 1 | |
| (25) | 1 | 2 | 24 | 4 | 2 | 1 | |
| . | 1 | 2 | 23 | 4 | 2 | 2 | |
| . | | : | | | : | | DOT ROW SPACE |
| (48) | 1 | 2 | 1 | 4 | 2 | 24 | |
| . | 1 | 3 | 1 | 4 | 3 | 24 | |
| . | 1 | 3 | 2 | 4 | 3 | 23 | |
| . | | : | | | : | | DOT ROW SPACE |
| . | 1 | 9 | 1 | 4 | 9 | 24 | |
| . | 1 | 9 | 2 | 4 | 9 | 23 | |
| . | | : | | | : | | LINE SPACE |
| (216) | 1 | 9 | 24 | 4 | 9 | 1 | |
| . | 2 | 1 | 24 | 5 | 1 | 1 | |
| . | 2 | 1 | 23 | 5 | 1 | 2 | |
| . | | : | | | | | |
| . | | : | | | | | LINE SPACE |
| | | : | | | | | |
| (432) | 2 | 9 | 1 | 5 | 9 | 24 | |
| . | 3 | 1 | 1 | 6 | 1 | 24 | |
| . | 3 | 1 | 2 | 6 | 1 | 23 | |
| . | | : | | | : | | |
| . | | : | | | : | | INCREMENT 3 |
| (638) | 3 | 9 | 24 | 6 | 9 | 1 | CHARACTER LINES |
| | 7 | 1 | 24 | 8 | 1 | 1 | + LINE SP |

From the foregoing table, it will be noted that in order for the hammer board 54 to print three character lines, it is necessary that the shift register 402 be loaded 648 times; i.e. 3 character lines×9 dot rows×24 dot columns. Thus, during read period 1, the shift register of hammer board 54 is loaded with the sixty six bits defining the pattern for character line 1, dow row 1, dot column 1. During the same read period, the shift register of hammer board 56 is loaded with the sixty six bits required to define character line 4, dot row 1, dot column 24. The information read from the dot buffer during successive read periods is defined by the table. Note that after every twenty four read periods, the paper must be moved by one dot row space. The processor unit 412 which controls the loading of the shift registers and the enabling of the hammer drivers, also controls both the hammer bank motor 130 and paper drive motor respectively via output terminals 430 and 432.

As indicated in the foregoing table, after nine dot rows have been printed, requiring 216 (9×24) read periods, the paper must be moved by one character line space. After 648 (3×216) read periods during which three complete character lines are printed by each of the hammer banks, the paper is moved by three complete character lines plus a line space. Thus, after the hammer boards 54 and 56 have been loaded during read period 648 with the bits required to print the last dot column in the ninth dot row of character lines 3 and 6, then the paper must be incremented by three full character lines plus a line space so as to move the three character lines just printed by the lower hammer bank 78 past the upper hammer bank 76.

The electronic control system of FIG. 8 has been disclosed so as to most simply depict one manner of operating the apparatus of FIGS. 4–7. It is readily recognized that other electronic control system configurations will be apparent to those skilled in the art which may be more efficient in that they do not require such a large dot buffer. For example, the dot buffer could store only 132 bits which at all times represent the next 66 dots to be printed by each bank. Such a configuration would call for the dot buffer to be loaded twenty four different times during each bank sweep; as by the processor 412 iteratively accessing dot information, as required, from the dot pattern ROM 416.

Although many variations will readily occur to those skilled in the art, one important aspect of FIG. 8 is that the shift register 402 and hammer driver 400 components 433 are mounted on the same hammer circuit board as the coils 224 which they control. Thus, servicing of the apparatus of FIGS. 4–7 is facilitated in that an entire hammer bank and the control electronics therefor can be easily field replaced.

Whereas the normal operation of the apparatus of FIGS. 4–7 controlled by the electronic system of FIG. 8 contemplates that the two hammer banks operate concurrently the inclusion of multiple banks provides redundancy to permit continued operation in the event of a failure on a board. In accordance with a significant feature of the invention, a bank disable switch means 500 is provided to permit automatic or user selection of whether the processor should provide data to both or either one of the circuit boards. The provision of the switch means 500 to define for the processor unit 412 whether both or either one of the hammer boards is to receive data, permits a user to maintain the printer apparatus in operation even in the event of a failure of one of the circuit boards. More particularly, in the event one of the circuit boards fails, the switch means 500 is operated, either automatically or by the user, to define a state which disables the failed board and causes the processor 412 to thereafter supply all of the data to the still functioning board.

In addition to the foregoing, FIG. 8 illustrates that the processor unit 412 drives a ribbon motor (not shown) via line 502 to pull the ribbon 73 from ribbon stuff box 75 and around guides 77 (FIG. 4). FIG. 8 also illustrates a convention operator panel 504 which enables the user to communicate various functional commands to the processor unit 412.

Although particular embodiments of the invention have been described and illustrated herein, it is recognized that modifications and variations may readily occur to those skilled in the art and consequently, it is intended that the claims be interpreted to cover such modifications and equivalents.

For example only, whereas the preferred embodiment depicted in FIGS. 3–7 utilizes two hammer boards, it should be understood that a greater number of hammer boards can be utilized to increase printing speed. In one implemented embodiment of the invention, each hammer bank prints 150 character lines per minute. Thus, a one hammer board embodiment prints 150 lines per minute and a two hammer board embodiment prints 300 lines per minute. In using the disclosed apparatus with only one hammer board, it is preferable to include a counter balancing weight for the missing board so that the hammer board drive motor still sees a balanced load. It should be recognized that a one hammer board embodiment of the invention can be readily field upgraded by introducing a second hammer board to double the print speed. It should also be recognized that other embodiments of the invention can utilize a greater number of hammer boards to further increase print speed; e.g. four boards enables printing at 600 lines per minute.

We claim:

1. A printing apparatus defining an elongated paper path and including means for moving paper along said path and means for printing a dot pattern on said paper in response to data signals defining a dot pattern for each of multiple dot rows to be printed, said apparatus comprising:

a plurality of print assembly banks including at least first and second banks;

said first print assembly bank including a plurality of print assemblies, each including a print element, mounted so as to align all of the print elements thereof along a first print row;

said second print assembly bank including a plurality of print assemblies, each including a print element, mounted so as to align all of the print elements thereof along a second print row;

means mounting said first and second print assembly banks adjacent to said paper path for reciprocal movement of the print elements thereof along said first and second print rows extending substantially parallel to one another and across substantially the entire width of said paper path;

drive means coupled to said first and second banks for reciprocally moving said banks to sweep each print element thereof alternately in first and second directions across a portion of the width of said paper path;

each of said print assemblies being selectively actuatable to cause the print element thereof to print dots on paper on said path during each sweep in both said first and second directions across said paper path; and means responsive to said data signals for concurrently actuating selected print assemblies on said first and second banks to concurrently print first and second dot rows on said paper.

2. The apparatus of claim 1, wherein said means for concurrently actuating includes processor means for actuating selected print assemblies in said first and second banks in accordance with said data signals;

bank disable switch means for selectively defining either a first or a second state; and wherein said processor means is responsive to said first state for concurrently actuating print assemblies in said first and second banks in accordance with said data signals and responsive to said second state for actuating only print assemblies in said first bank in accordance with said data signals.

3. The apparatus of claim 1 wherein said drive means includes a motor having an output member;

control means for actuating said motor to alternately move said output member in first and second opposite directions; and means physically coupling said motor output member to said first and second banks for moving said banks oppositely to one another to exhibit substantially equal loads to said motor for both directions of said output member movement.

4. The apparatus of claim 1 wherein said drive means includes a stepper motor having an output shaft; and means physically coupling said stepper motor output shaft to said first and second banks.

5. The apparatus of claim 4 further including bank control means for rotating said stepper motor shaft through a predetermined number of steps first in one direction and then in an opposite direction to thus sweep each print element across a predetermined number of dot positions.

6. The apparatus of claim 5 further including paper control means for causing said paper to move along said path one dot row after said stepper motor shaft moves through said predetermined number of steps in either direction.

7. The apparatus of claim 1 further including a data source supplying digital information representing the dot pattern to be printed;

switch means for selectively actuating said first and/or second print assembly banks; and processor means responsive to said switch means for actuating said print assemblies in said first and/or second banks in accordance with said digital information.

8. The apparatus of claim 1 wherein each of said print assemblies includes means for supporting the print element thereof, for reciprocal substantially linear movement, between a retracted position and an extended position.

9. The apparatus of claim 8 including permanent magnet means for drawing said print element to said retracted position;

bucking coil means selectively energizable to null the effect of said permanent magnet means on said print element; and spring means for propelling said print element from said retracted to said extended position.

10. A dot matrix line printer/plotter comprising:

paper control means for moving an elongated paper along a defined path;

multiple hammer banks including at least first and second banks;

said first bank including a first plurality of dot hammers aligned along a first print row;

said second bank including a second plurality of dot hammers aligned along a second print row;

means mounting said first bank adjacent to said defined paper path with said first print row extending across substantially the entire width of said paper path;

means mounting said second bank adjacent to said defined paper path with said second print row extending across substantially the entire width of said paper path, spaced from and substantially parallel to said first print row;

said means mounting said banks including means permitting reciprocal movement of said first and second banks along first and second linear paths respectively defined by said first and second print rows;

drive means coupled to said first and second banks for concurrently moving said banks along said first and second linear paths;

means supporting each of said first plurality of hammers in said first bank for reciprocal movement substantially perpendicular to said first print row and said paper path;

means supporting each of said second plurality of hammers in said second bank for reciprocal movement substantially perpendicular to said second print row and said paper path;

a source of data signals defining a dot pattern for each of multiple dot rows to be printed on said paper; and hammer control means responsive to said source of data signals for concurrently propelling selected hammers of both said first and second banks toward said paper during said movement of said banks in both directions along said first and second linear paths to concurrently print first and second dot rows thereon.

11. The apparatus of claim 10 wherein said hammer control means includes processor means for normally causing hammers on both said first and second banks to be concurrently propelled in accordance with said data signals;

switch means for selectively disabling either said first bank or said second bank and wherein said processor means is responsive to said switch means for propelling the hammers in accordance with said data signals only in a bank which is not disabled.

12. The apparatus of claim 10 wherein said drive means includes a motor; and means coupling said motor to said first and second banks for concurrently moving said banks in opposite directions along said linear paths so that said banks form balanced loads for both directions of movement.

13. The apparatus of claim 10 wherein said means mounting said first bank includes:

a first hammer bank circuit board; and means supporting said first hammer bank circuit board for reciprocal movement along a linear path defined by said first print row.

14. The apparatus of claim 13 wherein said first bank includes a first elongated plate supporting said first plurality of hammers; and means securing said first elongated plate and said first hammar bank circuit board to one another.

15. The apparatus of claim 10 wherein each of said hammers is supported for reciprocal linear movement between a retracted position spaced from said paper path and an extended position in contact with said paper path; and further including retracting means for drawing each of said plurality of hammers to its retracted position.

16. The apparatus of claim 11 wherein said data signals define successive dot rows as they are to appear on said paper; and wherein said processor means is responsive to said data signals for generating a multiple bit pattern for each dot row to be printed and for normally supplying selected ones of said multiple bit patterns to said first bank and other ones of said multiple bit patterns to said second bank; and wherein said processor means is responsive to said switch means disabling either of said banks for supplying all of said multiple bit patterns to the bank which is not disabled.

17. The apparatus of claim 15 wherein said hammer control means includes a plurality of individually actuatable means, each coupled to a different one of said hammers, and actuatable to null the action of said retracting means on the hammer coupled thereto.

18. The apparatus of claim 17 wherein said retracting means comprises permanent magnet means mounted proximate to said hammers; and wherein said plurality of individually actuatable means comprises a plurality of coils.

19. The apparatus of claim 17 further including a plurality of springs each coupled to a different one of said hammers for propelling the hammer to its extended position.

20. The apparatus of claim 2 wherein said data signals define successive dot rows as they are to appear on said paper and wherein said processor means is responsive to said data signals for generating a multiple bit pattern for each dot row to be printed; and wherein said processor means is responsive to said first state for supplying selected ones of said multiple bit patterns to said first bank print assemblies and other ones of said multiple bit patterns to said second bank print assemblies and responsive to said second state for supplying all of said multiple bit patterns to said first bank print assemblies.

21. A printing apparatus defining an elongated paper path and including means for moving paper along said path and means for printing rows of dots on said paper across the width thereof, said apparatus comprising:

a plurality of print assembly banks including at least first and second banks;

said first print assembly bank including a plurality of print assemblies, each including a print element, mounted so as to align all of the print elements thereof along a first print row extending across the width of said paper path;

said second print assembly bank including a plurality of print assemblies, each including a print element, mounted so as to align all of the print elements thereof along a second print row extending across the width of said paper path parallel to and spaced from said first print row by a distance substantially equal to X dot rows;

a source of data signals defining a dot pattern for each of N different dot rows to appear on said paper in the sequence 1, 2, . . . X, X+1, X+2, . . . N;

a processor means for selectively operating in a normal mode or a first bank disabled mode;

said processor means operable in said normal mode to respond to said data signal source for supplying signals to said first print assembly bank representing dot patterns of said rows 1, 2, . . . X and supplying signals to said second print assembly bank representing dot patterns of said rows X+1, X+2, . . . N and operable in said first bank disabled mode for supplying signals to said second print assembly bank representing dot patterns of said rows 1, 2, . . . X, X+1, X+2, . . . N.

22. The apparatus of claim 21 wherein said paper moving means is operable in said first bank disabled mode for moving said paper along said path in N successive dot row steps and operable in said normal mode for moving said paper along said path in X successive dot row steps and then moving said paper a distance substantially equal to N dot rows.

* * * * *